US008469358B1

(12) United States Patent
Wen

(10) Patent No.: US 8,469,358 B1
(45) Date of Patent: Jun. 25, 2013

(54) REGISTRATION AND TRANSPORT UNIT FOR A SHEET FEEDER

(75) Inventor: Hongcai Wen, Mississauga (CA)

(73) Assignee: Delphax Technologies Inc., Bloomington, MN (US)

( * ) Notice: Subject to any disclaimer, the term of this patent is extended or adjusted under 35 U.S.C. 154(b) by 0 days.

(21) Appl. No.: 13/439,909

(22) Filed: Apr. 5, 2012

(51) Int. Cl.
*B65H 9/16* (2006.01)

(52) U.S. Cl.
USPC ..... 271/250; 271/251

(58) Field of Classification Search
USPC ..... 271/250, 251
See application file for complete search history.

(56) References Cited

U.S. PATENT DOCUMENTS

| | | | | | |
|---|---|---|---|---|---|
| 3,929,327 | A * | 12/1975 | Olson | 271/250 |
| 4,775,142 | A * | 10/1988 | Silverberg | 271/251 |
| 5,657,983 | A * | 8/1997 | Fisk | 271/251 |
| 7,445,208 | B2 * | 11/2008 | Onodera | 271/239 |
| 2007/0023995 | A1 * | 2/2007 | Onodera | 271/226 |
| 2009/0091075 | A1 * | 4/2009 | Yasumoto | 271/250 |

* cited by examiner

*Primary Examiner* — David H Bollinger
(74) *Attorney, Agent, or Firm* — Stuart L. Wilkinson

(57) ABSTRACT

A sheet medium transport apparatus has a sheet guide mechanism with drive rollers and reaction rollers mounted for gripping a sheet guided by the guide mechanism. The drive rollers provide a drive component in a transport direction and a transverse drive component for driving a sheet so that a side edge of the transported sheet lodges against a registration plate. Once the sheet is registered against the registration plate, drive from the drive rollers causes the sheet edge to slide past the registration plate in the transport direction with the drive rollers sliding over the sheet.

21 Claims, 5 Drawing Sheets

REGISTRATION AND TRANSPORT UNIT FOR A SHEET FEEDER

FIELD OF THE INVENTION

This invention relates to apparatus for transporting and registering sheet media and to methods of using such apparatus. The apparatus has particular application for transporting and turning cut paper sheets to facilitate duplex printing.

BACKGROUND OF THE INVENTION

In practical terms, to achieve high speed duplex printing of paper sheets using inkjet print heads, it is necessary to use multiple print heads. Because conventional inkjet print heads print "down", it is necessary to turn a paper sheet between the action of a first print head printing on one surface of the sheet and a second print head printing on the reverse surface of the sheet. Turning a cut sheet over in a printer to enable printing on one side after printing on the other side is a difficult action at even moderate speeds. Moreover maintaining paper registration so that the front and back images are where they are supposed to be, is a challenging requirement.

SUMMARY OF THE INVENTION

According to one aspect of the invention, there is provided a sheet transport and registration apparatus comprising a first and second plurality of rollers mounted to define a first plurality of roller pairs, each roller pair having at least one drive roller for contacting a surface of a sheet to be transported through a series of nips formed by the roller pairs, a registration plate for registering a side edge of the sheet, a drive mechanism for rotating the drive rollers to drive the sheet through the series of nips with a first drive component in the transport direction and a second drive component in a direction transverse to the transport direction for driving the transported sheet against the registration plate, and a contact pressure control mechanism to set a contact pressure at each roller pair that is sufficiently high that the sheet is engaged by the nip to be driven in the transport direction and, when the side edge of the sheet is not registered at the registration plate, in the transverse direction, and that is sufficiently low that the drive roller slides over the sheet when the side edge of the sheet is registered at the registration plate.

The apparatus can further comprise a guide mechanism for guiding the sheet. The guide mechanism can be a pair of parallel plates with a first plurality of apertures in each of the plates, the apertures in the first plate aligned with respective apertures in the second plate, the first plurality of rollers mounted on one side of the parallel plates at the apertures for contacting a first surface of a sheet located in a guidance slot between the plates, and the second plurality of rollers mounted on the other side of the parallel plates at the apertures for contacting a reverse surface of the sheet. In such a parallel plate arrangement, the plates may be curved for turning a sheet through a prescribed angle. A guide mechanism for introducing a curve into the sheet as it is driven through the roller pairs can alternatively be provided by driving both rollers of the roller pairs, with outer rollers being driven faster than inner rollers so that one surface of the sheet is driven faster than the reverse surface to introduce the curve into the sheet as it is driven at the roller pairs. The guide mechanism can alternatively be configured as a series of shaped fins, the fins distributed transversely across the unit and presenting aligned curved edges to the sheet medium.

Preferably, each roller pair comprises the drive roller and an idler roller, the drive rollers each having an axis of rotation angled to the transport direction. The drive rollers are preferably generally equispaced along the length of the parallel plates in the transport direction and are preferably generally aligned in the transport direction.

The drive rollers are preferably located close to the registration plate and are supplemented by a second plurality of roller pairs mounted on the far side of the first plurality of roller pairs from the registration plate, the second plurality of roller pairs having drive rollers for driving a sheet in the transport direction.

Preferably, the roller pairs confine a sheet transported thereby to a transport locus, the registration plate having a groove generally tracking the transport locus for sliding engagement of the sheet side edge within the groove upon registration of the sheet at the registration plate. The drive rollers are preferably mounted on the outside of the curve with the other rollers of the roller pairs mounted on the inside of the curve.

The apparatus can have a sheet input end and a sheet output end with the parallel plates, at at least one end, presenting a flared entry way to the guidance slot for entry of a sheet to the apparatus. The apparatus can further comprise input and output extension units each having parallel plates for transportation of the sheet along slots defined between respective pairs of the parallel plates, the slots in the input and output extension units aligned with the guidance slot at respective ends of the parallel plates.

The apparatus can further include a pressure control device associated with at least one of the roller pairs for setting the contact pressure of the drive roller against the other roller for a sheet gripped between the drive roller and the other roller. Such a pressure control device preferably has an adjustment means to adjust the contact pressure, which adjustment means can be manually settable or can be set automatically in response to a detected change in a property of a sheet transported through the apparatus.

According to another aspect of the invention, there is provided a method of transporting a sheet comprising driving the sheet by means of a series of nips formed by a plurality of roller pairs, each roller pair including a drive roller contacting one surface of the sheet and a reaction roller contacting the reverse surface of the sheet, the drive roller driving the sheet with a first drive component in the transport direction and a second drive component in a direction transverse to the transport direction for driving the transported sheet against the registration plate, and setting contact pressures at the roller pair nips sufficiently high that the sheet engaged by the nip is driven in the transport direction, and is driven in the transverse direction when the side edge of the sheet is not registered at the registration plate, and sufficiently low that the drive roller slides over the sheet when the side edge of the sheet is registered at the registration plate.

BRIEF DESCRIPTION OF THE DRAWINGS

For simplicity and clarity of illustration, elements illustrated in the following figures are not drawn to common scale. For example, the dimensions of some of the elements are exaggerated relative to other elements for clarity. Advantages, features and characteristics of the present invention, as well as methods, operation and functions of related elements of structure, and the combinations of parts and economies of manufacture, will become apparent upon consideration of the following description and claims with reference to the accompanying drawings, all of which form a part of the specification, wherein like reference numerals designate corresponding parts in the various figures, and wherein:

DETAILED DESCRIPTION OF THE INVENTION INCLUDING THE PRESENTLY PREFERRED EMBODIMENTS

Figure 1:
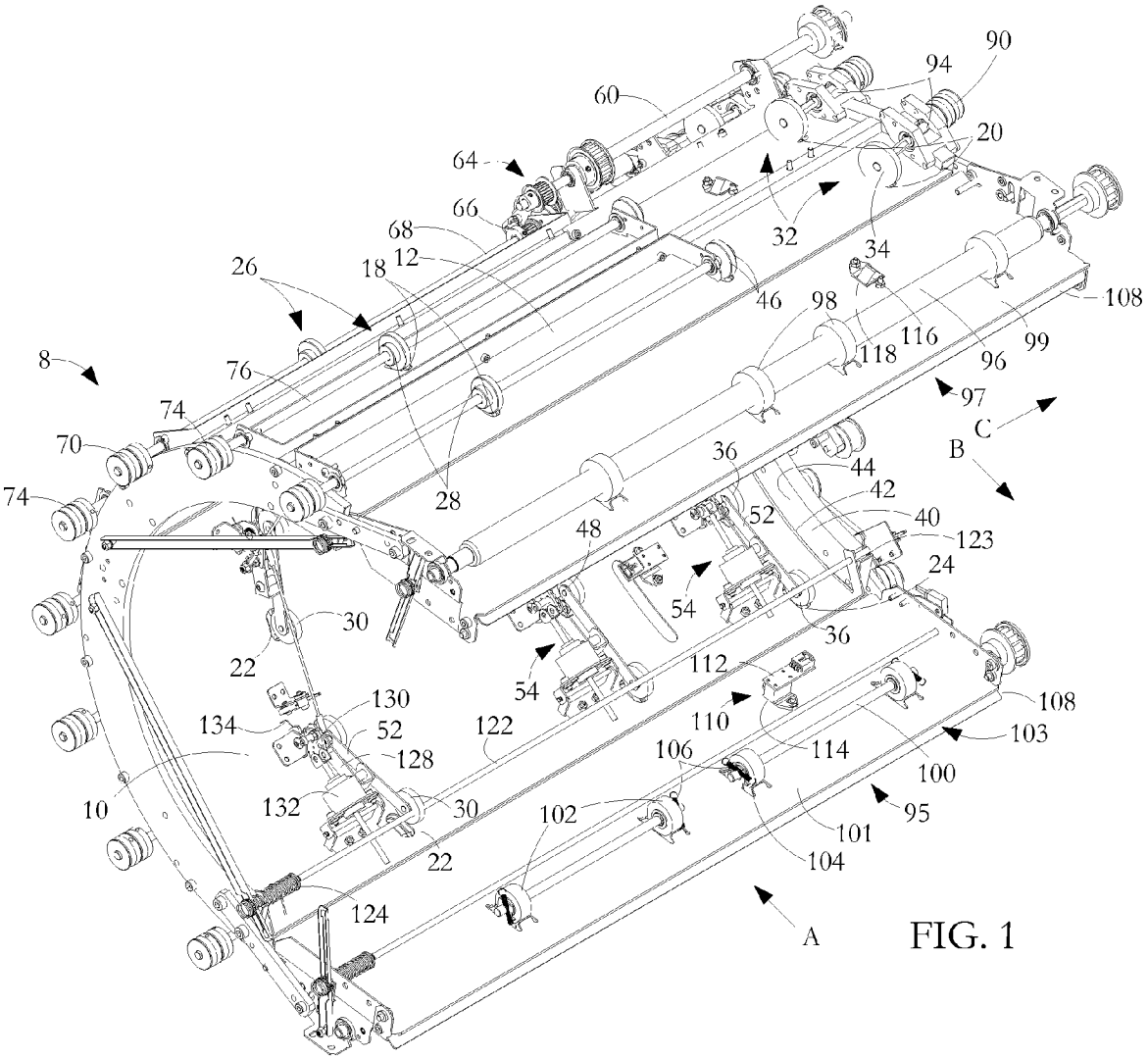
FIG. 1 is perspective view from the front and one side showing a sheet transport apparatus according to an embodiment of the invention.
Figure 2:
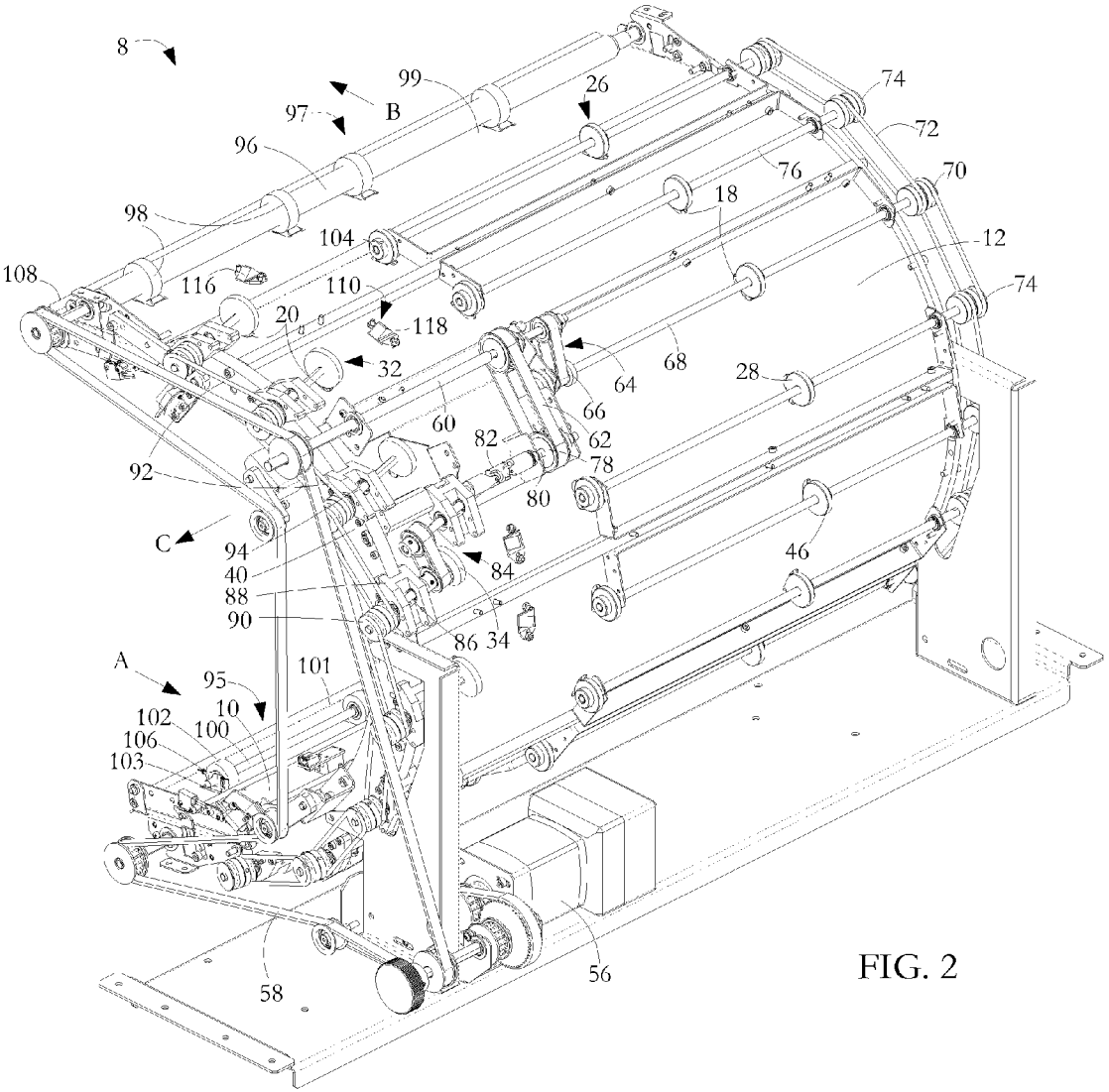
FIG. 2 is a perspective view from the rear and the other side of the apparatus of FIG. 1.

Referring in detail to FIGS. 1 and 2, a registration unit 8 for transporting sheet media has a pair of plates 10, 12 mounted in parallel relationship. The plates 10, 12 are spaced apart to leave a slot 14, as shown in the sectional view of FIG. 3, along which sheet media 16 are to be transported, and are curved so as to turn the transported sheet media 16 through a desired angle. The plate 10 has apertures 18, 20 distributed over its area, the apertures being aligned with corresponding apertures 22, 24 in the plate 12. At each set of aligned apertures is mounted a roller pair 26, 32 comprising a drive roller on the outside of the curve and an idler roller on the inside of the curve. In use, the roller pairs each form a nip for gripping a sheet located in the slot 14 and the drive roller of each pair is used to drive the sheet along the slot.

The registration unit 8 has two types of roller pair: straight roller pairs 26, each of which has a drive roller 28 and an idler roller 30, and angled roller pairs 32, each of which has a drive roller 34 and an idler roller 36. The straight roller pairs 26 apply to the sheet 16 a drive in the transport direction, while the angled roller pairs 32 apply to the sheet drive components in both the transport direction and a direction transverse to the transport direction. The transverse drive acts to establish and maintain a side edge 38 of the sheet in registration against a side registration plate 40. The roller pairs 26, 32 gripping the sheet, each deliver a small portion of the total force acting on the sheet 16 to drive the sheet forward though the registration unit 8 and, in the case of the roller pairs 32 to register its side edge against the plate 40. The registration unit 8 is used to transport and register cut sheets in preparation for printing or similar operations. The registration unit 8 is adapted for a range of paper area sizes, for different orientations, for enabling operations on both surfaces of the paper, and so as to accommodate a wide range of paper weights/thicknesses.

Figure 3:
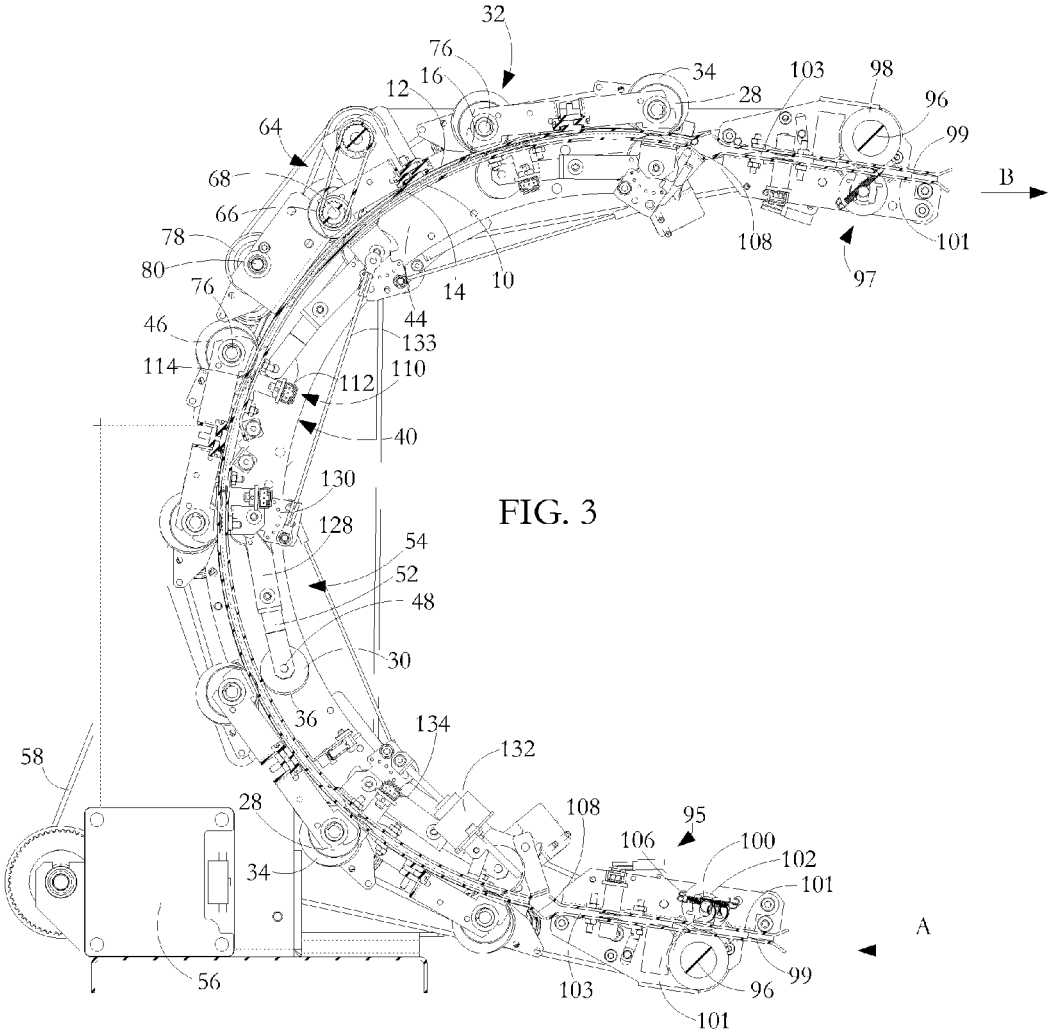
FIG. 3 is longitudinal sectional view through the apparatus of FIGS. 1 and 2.

In the embodiment illustrated in FIGS. 1 to 3, the plates 10, 12 are of a semicircular form for driving the transported sheet media 16 through an angle of 180 degrees, the slot 14 between the plates 10, 12 being of the order of 3 millimeters. The aligned apertures on the plates 10, 12 are arranged in a row column array to accommodate rows each of 3 roller pairs extending across the plates 10, 12, and columns each of 8 roller pairs extending in the transport direction. The apertures 18, 20, 22, 24 are slot shaped for accommodating the contact area between the drive roller and the idler roller of the associated roller pair 26, 32.

Figure 4:
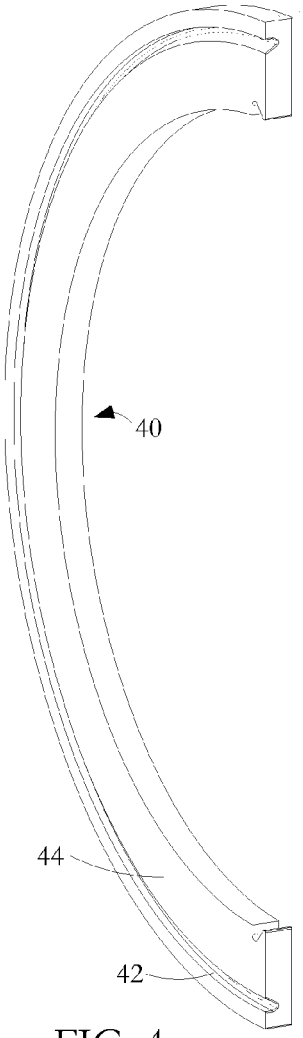
FIG. 4 is a perspective view of a registration plate forming part of the apparatus of FIGS. 1 and 2.
Figure 5:
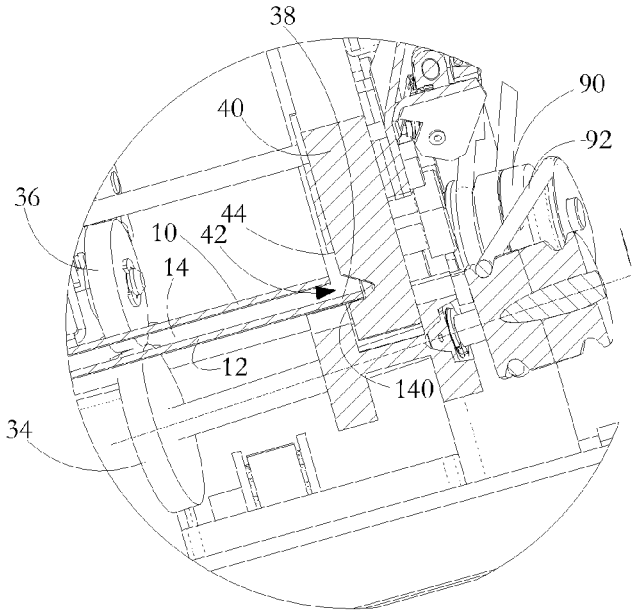
FIG. 5 is a detail of a longitudinal sectional view showing part of the registration plate of FIG. 4 and its configuration in relation to other parts of the apparatus of FIGS. 1 to 3.

The registration plate 40 is mounted to the outer plate 12 so at to block the side of the guidance slot 14 at the side of the apparatus nearest to the roller pairs 32. As shown in FIGS. 4 and 5, the registration plate 40 has a groove 42 set into a face 44 of the plate 40. When the registration plate is mounted in place, the groove 42 tracks the curvature of the slot 14. The groove is wider than the slot 14 and the plate 40 is mounted so that the groove, at its deepest point 140, is aligned with the plane curve of the sheet 16 when transported along the slot by the roller pairs 32. A shown in the detail view of FIG. 5, the groove 42 has an outer wall which is parallel to the sheet plane curve and an inner wall inclined to the plane curve. The outer plate 12 has an edge part which fits snugly against the groove outer wall. Base inclined regions extend from the groove walls to the point 140 and act to guide the edge 38 of the sheet medium at the bottom 140 of the groove as the sheet is driven through the registration unit. The sheet edge 38 slides along the bottom 140 of the groove 42 with the groove 42 acting as a trajectory guide.

The roller pairs 26 in the centre and right hand columns as shown in FIG. 2 are straight roller pairs which aid in moving wide or heavy paper through the registration unit 8. The straight roller pairs function as assist rollers. In some cases, such as when using lightweight paper of the order of 70 gsm caliber, the angled roller pairs may be sufficient of themselves to drive the paper through the transport apparatus and the contact pressure at the straight roller pairs 26 can be set to zero. In other cases, when the paper is thick and heavy, the assisting roller pairs 26 provide a straight driving force to help the paper go forward in the transport direction.

In contrast, roller pairs 32 of the left hand column adjacent the registration plate 40 are angled roller pairs. The number of roller pairs in both the column and row directions is not critical and is chosen as a compromise between avoiding excessive complexity and achieving, to the extent possible, uniform surface area application of drive to move the sheet 16 through the registration unit 8. Thus, for example, for very narrow sheets, just a single column of the angled roller pairs 32 next to the registration plate 40 is sufficient. It will be seen that the minimum sheet length that can be handled is set by the spacing of adjacent roller pairs in the transport direction.

As indicated, each of the roller pairs has a drive roller 28, 34 and an idler roller 30, 36. The drive rollers 28, 34 are moulded or machined from rubber or a synthetic elastomer, and the idler rollers 30, 36 are moulded or machined from a hard-wearing, low friction material such as high density polyethylene. In each case, the roller contact surfaces are cylindrical and extend parallel to the roller axis of rotation. Alternatively, the drive roller contact surface does not extent parallel to the roller axis of rotation. For example, the drive roller can have a slightly rounded contact surface in the manner of a car tire and will actually wear to such a form through continued use. Or, in another embodiment, the drive roller is frusto-conical in form as described presently with reference to FIG. 7 so that an edge region of the drive roller contacts the sheet. In each case, localized contact region can advantageously alter sheet control characteristics. Edges of the rollers are chamfered 46 so as to present an obtuse angle where the rollers 28, 30, 24, 36 bear against a sheet medium 16. The edges can alternatively be rounded. In both cases, the edge formation acts to distribute the pressure on the paper sheet 16 in the locality of the roller edge, so lessening the risk of damage to the sheet 16.

The idler rollers 30, 36 function to provide a required contact pressure at the nip between each idler roller 30, 36 and its associated drive roller 28, 34 to grip and move the sheet 16 through the registration unit 8. The idler rollers 30, 36 are mounted on shafts 48 fixed to connector bars 52 which link pairs of idler rollers 28, 30 that are adjacent one another in the sheet transport direction. The mounting position of each idler roller 28, 30 is set with a view to its sheet contact location lying in the natural plane curve of the sheet 16 where it is driven through its associated roller pair 26, 32. The idler rollers 30, 34 are on variable tensioned mounts 54 to accommodate different paper weights, thicknesses, sizes and orientations as will be described presently.

The drive rollers 28, 34 function to drive the sheet 16 through the curved registration unit 8 and to bias the sheet towards the registration plate 40. As shown in FIG. 2, drive to the drive rollers 28, 34 is provided by a motor 56 and a main timing belt 58 from which subsidiary drives are taken to each of the shafts on which the drive rollers are mounted. The speed of the motor 56 and therefore the belt 58 can be changed so as to alter the rate at which the drive rollers 28, 34 drive a sheet 16 through the registration unit 8.

As shown in FIG. 2, drive is applied from the main timing belt 58 to one end of a drive shaft 60 which drives a secondary timing belt 62 around a pulley system 64. Drive belts are not shown in FIGS. 1 and 3. A first roller pair drive is taken from pulley 66 of the pulley system 64 by means of a primary shaft 68 to which is mounted a double pulley 70. Belts 72 mounted on the pulley 70 drive corresponding double pulleys 74 on secondary shafts 76 parallel to the primary shaft 68. Spaced pairs of the straight drive rollers 28 are mounted on each of the primary and secondary shafts 68, 76.

A second drive is taken from pulley 78 of the pulley system 64. The pulley 78 is mounted on a stub shaft 80 which is connected through a universal joint 82 and a transfer linkage 84 to a stub shaft 86 on which is mounted one of the angled drive rollers, the stub shaft 86 being mounted at an angle of about—12 degrees to the stub shaft 80. However, the 12 degree angle of inclination of the drive roller drive direction to the transport direction is not critical. The stub shaft 86 is mounted for rotation in flanges 88. At the inner end of the stub shaft 86 is mounted one of the angled drive rollers 34. At the outer end of the shaft 86 is a double pulley 90 from which belt drives 92 are taken to adjacent stub shafts 94 by means of which drive is applied to neighbouring angled drive rollers 34. In turn, double pulleys of each of the adjacent stub shafts 94 relay the second drive by means of belt drives 92 to all of the other angled drive rollers 34.

The arrangement of angled roller pairs 34 is set up for passage of sheet media from an input end indicated by arrow A through to an output end indicated by arrow B. Thus, the straight roller pairs 26 apply a straight drive to the sheet 16 from A towards B. Meanwhile, the angled roller pairs 32 apply an angled drive to the sheet 16 having a component in the direction A to B, and a transverse component in the direction of arrow C to bias the moving sheet 16 towards the registration plate 40. If it is desired to reverse the sheet direction so that sheets are transported from B to A, the angle of each of the stub shafts is reversed by changing the orientation of the mounting flanges 88 and the sheet 16 is launched into the registration unit 8 at end B. In this way, when the direction of rotation of the drive rollers 34 is reversed, the sheet medium 16 will still be biased towards the registration plate 40.

At the input and output ends of the curved registration unit 8 are sheet input and output units 95, 97. These units each have parallel flat plates 99, 101 defining a slot 103 with the input and output units mounted so that the slot 103 of the input unit 95 is aligned with the input end of the slot 14 and the slot 103 of the output unit 97 is aligned with the output end of the slot 14. Mounted at each of the input and output units 95, 97 are respective drive shafts 96 which are driven by the main timing belt 58. The drive shafts 96 are mounted on the plates 99 and bear drive rollers 98. Corresponding shafts 100 are mounted on the plates 101 and bear idler rollers 102. The roller pairs 98, 102 cooperate though aligned apertures in the plates 99, 101 to grip a sheet located in the slot 103. Roller pairs of the input unit 95 operate to grip a sheet delivered into the slot from upstream transport equipment (not shown) and to drive it into the curved slot 14. Roller pairs of the output unit 97 operate to grip a sheet delivered into the slot 103 from the curved slot 14 and to drive it into downstream transport equipment (not shown). The end drive shafts 96 by means of their associated roller pairs 98, 102 therefore serve to drive a sheet 16 into the registration unit 8 at one end and to drive the sheet 16 out of the registration unit 8 at the other. The idler rollers 102 oscillate up and down at each end against a bias provided by springs 106 to accommodate a sheet being forced into or exiting the nip formed by the roller pairs 98, 102. To facilitate sheet entry at the input end, an edge region 108 of each plate 99, 101 is angled outwardly to present a funneled zone or mouth for sheet entry. As previously indicated, the registration unit 8 permits sheets to be injected from either end depending on how it is set up, so there is also a funneled zone at the opposite end. The mouth formation can alternatively be achieved by having the edge of only one of the plates 99, 101 angled at the input end. The groove 42 in the registration plate 40 also widens towards the ends of the unit to provide a correspondingly flared entry way. While an entry way at both ends of the registration unit 8 enables the unit to be turned around for feeding sheets from either direction, it will be realized that the registration unit 8 can alternatively have dedicated entry and exit ends.

A number of optical sensors 110 are distributed throughout the unit, each sensor comprising a light emitter detector unit 112 mounted at an aperture 114 in the curved plates 10, and a mirror unit 116 mounted at an aperture 118 in the curved plate 12. The sensors 110 detect whether a sheet is present or not and signals from the array of sensors 110 are used to detect both the existence of a paper jam and the likely position of that jam.

For removing jams, the plates 10, 12 can be separated by unclipping the inner plate 10 at one end of the registration unit 8 and hinging the plate 10 about a hinge formation at the other end of the unit. The plates 10, 12 are locked in position during operation of the registration unit by a locking bar 122 which is normally biased by spring 124 to a locked position, but which can be moved axially against the action of the spring 124 to release the end of the bar 122 from a retainer 123. Once the plate 10 has been moved to the open position, the paper jam is cleared and the plate 10 is subsequently hinged to the closed position and locked in the sheet transport configuration. The structure for locking and unlocking the plates 10, 12 can alternatively take any of a number of suitable forms. For example, it can use a spring loaded tongue or a magnetic structure.

It is important that the correct contact pressure is applied to a sheet 16 being moved through the registration unit 8. Both too much contact pressure and too little contact pressure at the sheet contact nip formed by a roller pair can cause the sheet to stall. With too much contact pressure, the nip becomes a clamp. Also, for very lightweight papers, with excess contact pressure, there is a risk of damage by wrinkling, scuffing or tearing. With too little contact pressure, the drive roller skims the sheet surface and does not impart sufficient frictional drive in the sheet transport direction to move it. A desired nip contact pressure is also a function of paper surface condition; in particular, whether it is rough or smooth.

The contact pressure at the angled roller pairs 32 is particularly important. The transverse drive component must be sufficient to drive a sheet 16 to seat the paper side edge 38 against the registration plate 40 and to keep it there as the drive rollers 28, 34 move the sheet through the registration unit 8 in the transport direction. However, to avoid a paper edge 38 from crumpling, the contact pressure must be sufficiently low that the angled rollers 34 slip once the paper sheet 16 is in registration against the plate 40 and as the paper exits the unit. The angled rollers 34 which produce registration act to distribute seating force on the sheet edge 38 being registered over the entire length of the sheet.

The registration unit 8 has contact pressure governing mounts 54 for setting the contact pressure at the roller pairs 26, 32. The mounts 54 permit adjustment of the idler rollers 30 or 36. However, it will be appreciated that such an adjustment mechanism can, at the cost of greater complexity, be adapted for adjustment of the drive rollers. Each mount 54 acts on an inline pair of idler rollers 30 or 36, and includes a connecting bar 52 to which the idler rollers 30 or 36 are freely mounted. The bar 52 is connected at its centre to a force transfer bar 128 which is connected at its outer end to a contact pressure adjustment plate 130. The angular position of one of the adjustment plates 130 for an associated column of roller pairs is set by the setting of a stepping motor 132 and is relayed to the others of the series of adjustment plates in the column by cables 133. The adjustment plate angular positions correspond to positions of the associated idler roller in a direction orthogonal to the curve plane of the sheet 16 as it passes through the nips formed by the associated roller pairs 26, 32. The position of the idler rollers 30, 36, in turn, determines the pressure applied at the associated roller pairs 26, 32 to the sheet 16 located at the nips. The idler rollers 30, 36 are spring loaded through bars 52 and bars 128 by torsion springs 134 with one leg of each torsion spring 134 clamped to bar 128 and the other leg clamped to adjustment plate 130. Under pressure from the torsion springs 134, the idler rollers 30, 36 always touch drive rollers 28, 34 (or the paper between them). A position change of adjustment plates 130 changes the leg angle of torsion springs 134, thus changing the pressure between idler rollers 30, 36 and drive rollers 28, 34. The cables 133 serve to adjust the tension of the four pairs of idler rollers simultaneously so as to achieve the same tension at each idler roller 30, 36. It will be appreciated that a range of possible mechanisms can be used to adjust and maintain the contact pressure at a roller pair 26, 32. The positions of the idler rollers 30, 36 are essentially fixed during a run, with torsion springs 134 ensuring that the drive roller touches a corresponding idler roller when no sheet is present and touches the sheet when it is in the nip. The mechanisms can be individually controlled or ganged together to apply pressure control in common to the roller pairs 26, 32. In addition the contact pressure at a particular roller pair may be made separately adjustable.

In the illustrated embodiment, the mounts 54 are manually adjustable by applying a particular setting at the stepping motor 132. Such an arrangement is suitable where a particular printing run takes place over an extended period with a standard paper type and thickness. The pressure units are adjusted so as to apply the required pressure at the roller pair contact zones before the print run begins and are not altered until the print run is complete. In an alternative arrangement (not shown), the mounts are automatically controlled. Sensors are used to detect paper thickness and surface type and the setting of the pressure modules is altered whenever a change in paper thickness or surface type is detected requiring adjustment of the contact pressure zone in order to maintain optimal transport dynamics.

The contact pressure exerted at the roller pairs 26, 32 may be set at an identical level throughout the roller pair array or may be individually tailored to the rollers depending on desired sheet movement dynamics or operational characteristics of the registration unit 8. For example, a higher contact pressure may be adopted at the straight roller pairs 26 than the angled roller pairs 32.

Figure 6:
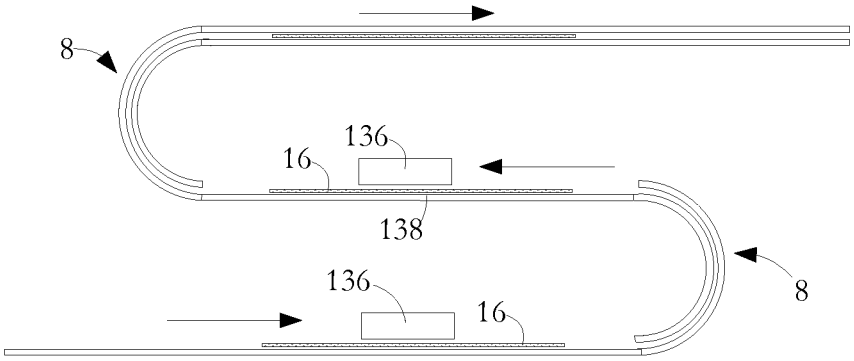
FIG. 6 is a schematic view showing the use of apparatus of FIGS. 1 to 3 to maintain a sheet in registration as it is transported through an S-form locus for duplex inkjet printing of the sheet.

FIGS. 1 and 2 show a registration unit 8 for taking a sheet through 180 degrees. The principles of the structure illustrated can be applied to any transport locus from essentially zero degrees, where the paper is registered against the registration plate but is not turned at all, to a complete 360 degree turn provided, in the latter case, a necessary lateral—i.e. transverse—accommodation is made. In another implementation, two 180 degree units 8 can be mounted in an S-configuration as shown in FIG. 6, this arrangement being used, for example, to move the sheet unidirectionally through a printing or like operation, but successively to present each side of the sheet upwardly for an operation such as printing by inkjet print heads 136. A reverse direction section 138 is kept as short as possible commensurate with having a length sufficiently long to permit the second printing step to be performed. After reverse side printing, the paper sheet 16 is returned to a first surface up configuration, the sheet then being moved in the original direction but at a different height. Throughout the movement of the sheet around the S-locus, the sheet is retained against appropriately configured registration plates mounted to the parallel plates in each section of the apparatus.

It will be appreciated that the curved plates 10, 12 serve to guide the paper sheet 16 smoothly through a desired angle with the drive being applied by the roller pairs 26, 32. Other means can alternatively be adopted to achieve a desired turn. Thus, even absent the guide represented by the curved plates 10, 12, the illustrated array of roller pairs 26, 32 still turns the sheet 16 through the required angle but the sheet 16 may depart from a desired smooth plane curve locus between roller pairs 26 or 32 that are adjacent in the transport direction. Thus, the sheet 16 may either balloon out between longitudinally adjacent roller pairs 26, 32 or may have a straight planar span between longitudinally adjacent roller pairs 26, 32. Neither situation is good either for maintaining sheet quality or for avoiding paper jams. In an alternative embodiment of the invention, either one or both of the curved plates 10, 12 and their guiding function is obviated by driving both rollers of each roller pair 26, 32, establishing enhanced control of the individual roller pairs 26, 32 and carefully monitoring the sheet position and configuration as it is passes through the registration unit. In such control, the contact pressure and relative speed of the rollers of each roller pair are dynamically adjusted by applying control adjustments to the drive rollers in response to detected changes in sheet position and configuration. In this way, the required smooth curve locus of the paper sheet is maintained as it passes through the registration unit. In another embodiment (not shown), the parallel plate arrangement is replaced by a series of parallel planar fins, the fins orientated orthogonally to the orientation of a sheet being transported through the registration unit, and being spaced transversely of the registration unit, the fins having curved edges to define a guide path for the transported sheets.

Although in the embodiment illustrated in FIGS. 1 to 3, the outer roller of each roller pair 26, 32 is the drive roller 28, 34 and the inner roller is the idler roller 30, 36, the function of the rollers can be reversed so that the inner roller drives and the outer roller idles. In a further alternative, both rollers of either or both of the roller pairs 26, 32 can be driven, either synchronized to achieve substantially identical drive at both surfaces of the sheet or differentially in either or both of the transport and transverse directions so as to achieve desired paper movement dynamics.

Figure 7:
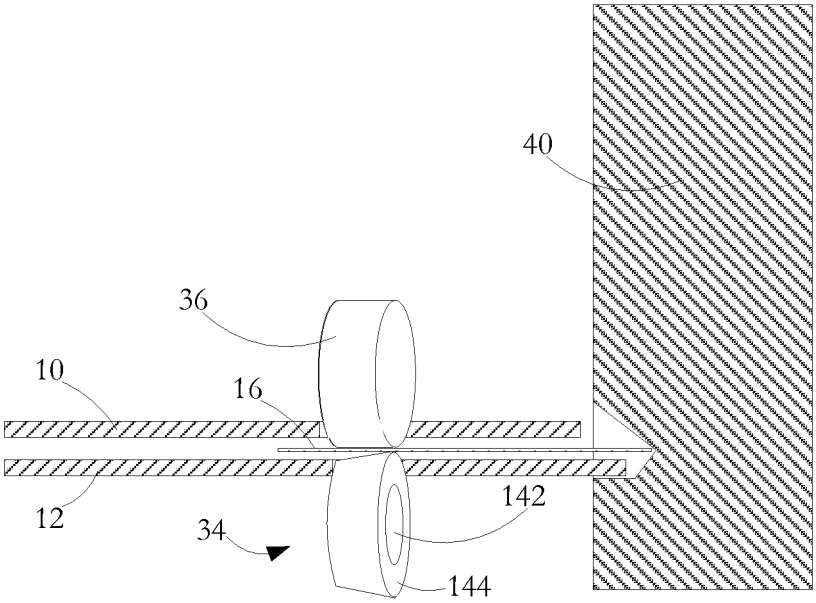
FIG. 7 illustrates interaction of a drive roller and reaction roller according to an embodiment of the invention.

In a variation of the angle roller pair design as illustrated by FIG. 7, the angled drive roller 34 is a two part structure, having a rigid hub 142 and an annular member 144 at the circumference of the disc member which is elastically deformable in the nature of a soft solid tire. The radius of the annular member 144 adjacent one edge—the forward edge when mounted in a roller pair arrangement—is less than the radius of the annular member at its trailing edge. The advantage this form of drive roller is revealed in normal operation, after a sheet that is being transported becomes registered against the registration plate, and the angled drive roller 34 starts to slide over the sheet. If the contact area is large and extends across the width of the drive roller, there is a tendency for vibration as the transported sheet 16 slides through the contact area between the drive roller 34 and the idler roller 36. In the arrangement of FIG. 7, there is less of a tendency for a transported sheet to cause vibration as it passes between the rollers of the angled roller pair.

By changing the speed of motor 56, the registration unit 8 can be operated at any of a range of sheet transport speeds. The structure and operation of the roller pairs 26, 32 means that a range of paper thicknesses, including common paper thickness in the 60-360 gsm range, can be accommodated, with even lower paper weights being accommodated subject to appropriate tension adjustment. The preferred embodiment illustrated, has an end-to-end length and a side-to-side width chosen to accept paper 8 to 25 inches in length and 8 to 20 inches in width.

Other variations and modifications will be apparent to those skilled in the art. The embodiments of the invention described and illustrated are not intended to be limiting. The principles of the invention contemplate many alternatives having advantages and properties evident in the exemplary embodiments.

What is claimed is:

1. A sheet transport and registration apparatus comprising:

a first and second plurality of rollers mounted to define a first plurality of roller pairs, each roller pair having at least one drive roller for contacting a surface of a sheet to be transported through a series of nips formed by the roller pairs, a registration plate for registering a side edge of the sheet, a drive mechanism for rotating the drive rollers to drive the sheet through the series of nips with a first drive force component in the transport direction and a second drive force component in a direction transverse to the transport direction for driving the transported sheet against the registration plate, and a contact pressure control mechanism to set a contact pressure at each roller pair that is sufficiently high that the sheet is engaged by the nip to be driven in the transport direction; and in the transverse direction when the side edge of the sheet is not registered at the registration plate, and that is sufficiently low that the sheet is driven in the transport direction but the sheet and the drive roller slide relative to one another in the transverse direction when an edge of the sheet is registered at the registration plate.

2. Apparatus as claimed in claim 1, further comprising a guide mechanism for guiding the sheet.

3. Apparatus as claimed in claim 2, the guide mechanism comprising a pair of parallel plates, a first plurality of apertures in each of the plates, the apertures in the first plate aligned with respective apertures in the second plate, the first plurality of rollers mounted on one side of the parallel plates at the apertures for contacting a first surface of a sheet located in a guidance slot between the plates, and the second plurality of rollers mounted on the other side of the parallel plates at the apertures for contacting a reverse surface of the sheet.

4. Apparatus as claimed in claim 3, the plates being curved for turning a sheet on transportation thereof through a prescribed angle.

5. Apparatus as claimed in claim 4, the drive rollers mounted on the outside of the curve and the other rollers of the roller pairs mounted on the inside of the curve.

6. Apparatus as claimed in claim 4, the apparatus having a sheet input end and a sheet output end, the parallel plates, at at least one end, presenting a flared entry way to the guidance slot for entry of a sheet to the apparatus.

7. Apparatus as claimed in claim 6, further comprising input and output extension units each extension unit having parallel members for transportation of the sheet along slots defined between respective parallel members, the slots in the input and output extension units aligned with the guidance slot at respective ends of the parallel plates.

8. Apparatus as claimed in claim 1, each roller pair comprising the drive roller and an idler roller.

9. Apparatus as claimed in claim 1, the drive rollers each having an axis of rotation angled to the transport direction.

10. Apparatus as claimed in claim 1, the drive rollers generally equispaced along the length of the parallel plates in the transport direction.

11. Apparatus as claimed in claim 1, the drive rollers generally aligned in the transport direction.

12. Apparatus as claimed in claim 1, the drive rollers located close to the registration plate.

13. Apparatus as claimed in claim 1, further comprising a second plurality of roller pairs mounted on the far side of the first plurality of roller pairs from the registration plate, the second plurality of roller pairs having drive rollers for driving a sheet in the transport direction.

14. Apparatus as claimed in claim 1, the roller pairs confining a sheet transported thereby to a transport locus, the registration plate having a groove generally tracking the transport locus for sliding engagement of the side edge within the groove upon registration of the sheet at the registration plate.

15. Apparatus as claimed in claim 1, further comprising a motor and power train for driving the drive rollers.

16. Apparatus as claimed in claim 1, the drive rollers each having a relatively rigid hub portion and an elastic tire portion.

17. Apparatus as claimed in claim 1, at least one of the roller pairs having an associated pressure control device to set the contact pressure of the drive roller against the other roller for a sheet gripped between the drive roller and the other roller.

18. Apparatus as claimed in claim 17, the pressure control device having an adjustment means to adjust the contact pressure.

19. Apparatus as claimed in claim 18, the adjustment means operable automatically in response to a detected change in a property of a sheet transported through the apparatus.

20. Apparatus as claimed in claim 1, the drive rollers being frusto-conical in shape.

21. A method of transporting a sheet comprising using a series of nips formed by a plurality of roller pairs, each roller pair including a drive roller contacting one surface of the sheet and a reaction roller contacting the reverse surface of the sheet, the method comprising operating the drive rollers to apply to the sheet at said nips a first drive force component in a transport direction and a second drive force component in a direction transverse to the transport direction, and setting the contact pressures at the nips sufficiently high that the sheet is driven in the transport direction by the first drive force component, and is driven in the transverse direction by the second drive force component when the sheet is free to move in the transverse direction, and sufficiently low that the sheet and the drive roller slide relative to one another in the transverse direction if the sheet is prevented from moving in the transverse direction by a side edge of the sheet abutting a registration plate.

* * * * *